US008128792B2

(12) United States Patent
Hiraiwa et al.

(10) Patent No.: US 8,128,792 B2
(45) Date of Patent: Mar. 6, 2012

(54) FLUORINE GAS GENERATOR

(75) Inventors: Jiro Hiraiwa, Nishiyodogawa-ku (JP); Osamu Yoshimoto, Nishiyodogawa-ku (JP); Tetsuro Tojo, Nishiyodogawa-ku (JP)

(73) Assignee: Toyo Tanso Co., Ltd., Osaka (JP)

( * ) Notice: Subject to any disclaimer, the term of this patent is extended or adjusted under 35 U.S.C. 154(b) by 1491 days.

(21) Appl. No.: 10/661,638

(22) Filed: Sep. 15, 2003

(65) Prior Publication Data

US 2004/0055874 A1 Mar. 25, 2004

(30) Foreign Application Priority Data

Sep. 20, 2002 (JP) ..... 2002-274489

(51) Int. Cl.
*C25B 9/00* (2006.01)
*C25B 1/24* (2006.01)

(52) U.S. Cl. ..... 204/279; 204/263; 204/266; 204/275.1; 204/277; 204/278; 204/194; 205/359; 205/411; 205/459

(58) Field of Classification Search ..... 205/619, 205/637, 620, 359, 411, 459; 204/243.1, 204/245–247, 275.1, 276, 242, 287, 263, 204/266, 277, 279
See application file for complete search history.

(56) References Cited

U.S. PATENT DOCUMENTS

| | | | | |
|---|---|---|---|---|
| 4,790,859 | A * | 12/1988 | Marumo et al. | 95/138 |
| 5,980,726 | A | 11/1999 | Moulthrop, Jr. et al. | |
| 6,656,334 | B2 * | 12/2003 | Tseng et al. | 204/276 |
| 6,818,105 | B2 | 11/2004 | Tojo et al. | |
| 2004/0007457 | A1 * | 1/2004 | Tojo et al. | 204/247 |

FOREIGN PATENT DOCUMENTS

| | | |
|---|---|---|
| CN | 1441857 | 9/2003 |
| GB | 2 202 551 | 9/1988 |
| JP | 61-114199 | 7/1986 |
| JP | 64-015373 | 1/1989 |
| JP | 05-005194 | 1/1993 |
| JP | 10-199814 | 7/1998 |
| JP | 2000-160390 | * 6/2000 |
| JP | 2001-295086 | 10/2001 |
| WO | WO 01/77412 | * 10/2001 |

* cited by examiner

*Primary Examiner* — Roy King
*Assistant Examiner* — Lois Zheng
(74) *Attorney, Agent, or Firm* — Oblon, Spivak, McClelland, Maier & Neustadt, L.L.P.

(57) ABSTRACT

A fluorine gas generator is provided with which the gases used and/or generated, in case of leakage thereof, can be prevented from mixing together as far as possible and, even in case of gas leakage into the outside of the generator system, the leakage gas can be treated safely and in which the maintenance, exchange and other operations are easy to carry out. The generator comprises a box-shaped body containing an electrolyzer for fluorine gas generation, and the box-shaped body is divided into two or more compartments, including a compartment containing the electrolyzer.

10 Claims, 4 Drawing Sheets

FLUORINE GAS GENERATOR

BACKGROUND OF THE INVENTION

1. Field of the Invention

The present invention relates to a fluorine gas generator and, more particularly, to a fluorine gas generator for producing high-purity fluorine gas having a very low impurity content and suited for use in the process of manufacturing semiconductors and so on.

2. Description of the Prior Art

Fluorine gas is a basic gas indispensable in the field of semiconductor production, for instance. While it is used as such in some instances, the demand in particular for nitrogen trifluoride gas (hereinafter referred to as "$NF_3$ gas") and the like synthesized based on fluorine gas for use as cleaning gases or dry etching gases for semiconductors has been rapidly increasing. Further, neon fluoride gas (NeF gas), argon fluoride gas (ArF gas), krypton fluoride gas (KrF gas) and the like are excimer laser oscillator gases used in the step of patterning integrated semiconductor circuits, and the raw materials therefor in frequent use are mixed gases composed of a rare gas and fluorine gas.

Fluorine gas and $NF_3$ gas to be used in the production of semiconductors and so forth are required to have a high level of purity with a minimum impurity content. On each actual site of production of semiconductors or the like, a required amount of fluorine gas is taken out for use from a fluorine gas-containing cylinder. Therefore, it is very important to secure and manage the sites of storage of gas cylinders and the safety and purity of the gas. Furthermore, $NF_3$ gas is rather in short supply due to the rapidly increasing demand therefor and, accordingly, a problem arises that a certain amount of the gas should be always in storage. When these factors are taken into consideration, installation of an on-demand and on-site fluorine gas generator at the place of use thereof is preferred to handling high-pressure fluorine gas.

Generally, fluorine gas is generated from such an electrolyzer as shown in FIG. 4. The electrolyzer body 201 is generally made of Ni, Monel, carbon steel, or the like. Furthermore, for preventing the hydrogen gas and fluorine gas generated from being mixed together, the electrolyzer body 201 is provided, at the bottom thereof, with a bottom plate 212 made of polytetrafluoroethylene or the like. The electrolyzer body 201 is filled with a mixed molten salt comprising a potassium fluoride-hydrogen fluoride system (hereinafter referred to as "KF—HF system") as an electrolytic bath 202. The electrolyzer body is divided into an anode chamber or section 210 and a cathode chamber or section 211 by means of a skirt-shaped partition wall 209 made of Monel or the like. Fluorine gas is generated when electrolysis is conducted by applying a voltage between a carbon or nickel (hereinafter, "Ni") anode 203 disposed within the anode chamber 210 and a Ni cathode 204 disposed within the cathode chamber 211. The fluorine gas generated is discharged through a discharge port 208, and the hydrogen gas generated on the cathode side is discharged through a hydrogen gas discharge port 207. The fluorine gas and hydrogen gas generated each contains a small amount of hydrogen fluoride gas (hereinafter, "HF") coming from the mass retained in the anode chamber 210 and cathode chamber 211 and, for eliminating the same, each gas is passed through an HF adsorption tube connected to the downstream of each discharge port. When the level of the electrolytic bath lowers to a certain level as a result of fluorine gas generation, HF is fed directly to the electrolytic bath through an HF feeding line 213 extending from outside the electrolyzer to within the electrolytic bath in the cathode chamber. The feeding of HF is carried out in association with a sensor system (not shown) monitoring the level of the electrolytic bath. (Patent Document 1: Laid-open Japanese Patent Application (JP Kohyo) H09-505853).

However, since all relevant production plants are not always equipped with safety means exclusively for on-demand and on-site fluorine gas generators and since various gases are used or generated in or from fluorine gas generators, it is difficult to safely treat those gases which have incidentally leaked out of the fluorine gas generators due to some or other trouble. In every site of production, it is required that maintenance, exchange and other operations be easy to carry out. It has been found that there is a problem, namely such requirements cannot always be met.

The present invention, which has been made in view of the problems discussed above, has for its object to provide a fluorine gas generator with which the gases used or generated can be prevented from mixing together as far as possible in case of gas leakage and can be treated safely without allowing them to escape to the outside and with which maintenance, exchange and other operations can be carried out with ease.

SUMMARY OF THE INVENTION

To solve the above problems, the invention provides, in a first aspect thereof, a fluorine gas generator as defined in Claim 1 which comprises a box-shaped body and an electrolyzer for fluorine gas generation contained therein and is characterized in that the box-shaped body is divided into two or more compartments, including a compartment containing the electrolyzer.

According to this constitution, the electrolyzer is contained in a specific compartment and is separated from another compartment or other compartments containing other means and apparatus connected to the electrolyzer and, therefore, even in case of gas leakage from the electrolyzer, the gas will not flow into another or other compartments containing other means and apparatus.

In another aspect, the invention provides a fluorine gas generator as defined in Claim 2 which comprises an electrolyzer containing an electrolytic bath composed of a mixed molten salt containing hydrogen fluoride and divided into an anode chamber with an anode disposed therein and a cathode chamber with a cathode disposed therein, first adsorption means for adsorbing hydrogen fluoride from the fluorine gas discharged from the anode chamber, second adsorption means for adsorbing hydrogen fluoride from the hydrogen gas discharged from the cathode chamber, and a box-shaped body containing the electrolyzer, first adsorption means and second adsorption means and which is characterized in that the box-shaped body comprises three compartments, namely a first compartment containing the electrolyzer, a second compartment containing the first adsorption means, and a third compartment containing the second adsorption means.

According to this constitution, the gas fed, as a raw material, to the electrolyzer is anhydrous hydrogen fluoride, the main component of the gas treated in the first adsorption means is hydrogen, and the main component of the gas treated in the second adsorption means is fluorine, hence they are different from one another and, therefore, the box-shaped body containing these means or apparatus is divided into three compartments, namely the first compartment containing the electrolyzer, the second compartment containing the first adsorption means, and the third compartment containing the second adsorption means. Accordingly, the gas leaking out of one compartment will not mix with the gas leaking out of another compartment. Thus, a substantially single component gas can be treated in each compartment, and improvements in safety can thus be achieved.

The fluorine gas generator according to Claim 2 preferably has an opening for suctioning the internal air for each of the first to third compartments, as defined in Claim 3.

When, according to this constitution, the internal air is suctioned from each compartment through the suction opening provided therefor, the leakage gas will be eliminated from the box-shaped body without escaping into the outside atmosphere so that the leakage gas can be treated suitably.

The fluorine gas generator according to Claim 2 or 3 preferably comprises, additionally, reservoir means for storing fluorine gas after passing through the first adsorption means, and pressurizing means for pressurizing the fluorine gas from the reservoir means, both contained in the second compartment, as defined in Claim 4.

According to this constitution, the reservoir means and pressurizing means, both of which treat fluorine gas, are contained, together with the first adsorption means, in the second compartment for handling fluorine gas and, accordingly, a substantially single component gas can be treated in the second compartment and an improvement in safety can be improved.

The fluorine gas generator according to Claim 2 or 3 preferably comprises, additionally, a water heating device contained in the first compartment for feeding warm water for heating the electrolyzer, as defined in Claim 5.

According to this constitution, the water heating device is an attachment device to the electrolyzer and is contained in the first compartment together with the electrolyzer. In this manner, the piping between the electrolyzer and water heating device can be simplified.

The fluorine gas generator according to Claim 2 preferably comprises, additionally, a transporting member carrying the electrolyzer and capable of entering and leaving the first compartment, as defined in Claim 6.

According to this constitution, the electrolyzer, together with the transporting member, can be taken out of the first compartment on the occasion of electrolyzer exchange or maintenance and, after exchange or maintenance, a new electrolyzer or the electrolyzer can be carried into the first compartment by means of the transporting member.

The fluorine gas generator according to Claim 6 preferably comprises, additionally, two or more HF adsorption means switchable to one another as included in the first adsorption means and each placed on a transporting member capable of entering and leaving the second compartment, as defined in Claim 7.

According to this constitution, each first adsorption means, together with the transporting member, can be taken out of the second compartment on the occasion of exchange or maintenance thereof and, after exchange or maintenance, a new first adsorption means or the first adsorption means can be carried into the second compartment.

The fluorine gas generator according to Claim 6 preferably comprises two or more HF adsorption means switchable to one another as included in the second adsorption means and each placed on a transporting member capable of entering and leaving the third compartment, as defined in Claim 8.

According to this constitution, each second adsorption means, together with the transporting member, can be taken out of the third compartment on the occasion of exchange or maintenance thereof and, after exchange or maintenance, a new second adsorption means or the second adsorption means can be carried into the third compartment.

DETAIL DESCRIPTION OF THE PREFERRED EMBODIMENTS OF THE INVENTION

In the following, a typical embodiment of the fluorine gas generator of the invention is described referring to the accompanying drawings.

Figure 1:
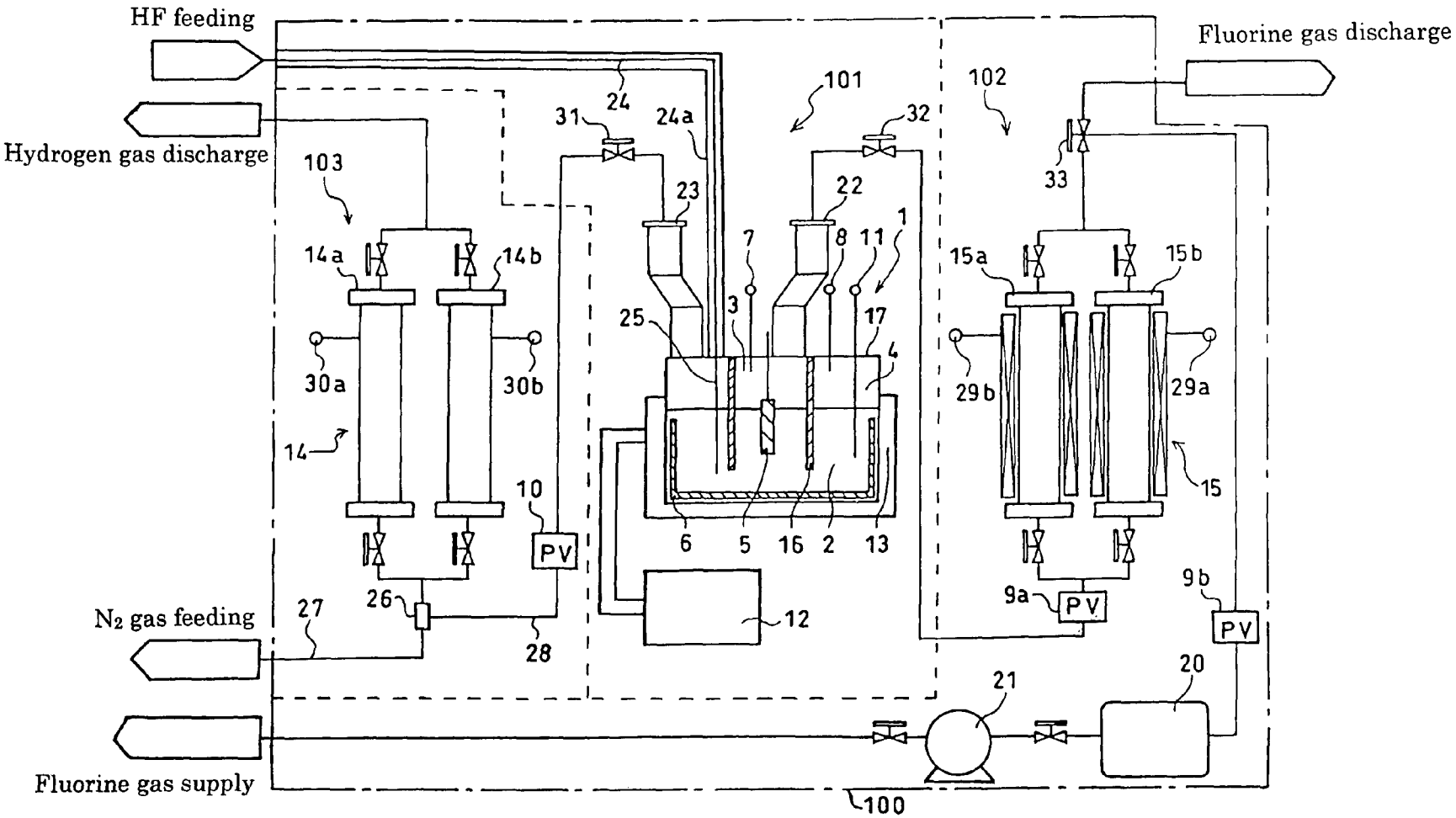
FIG. 1 is a schematic representation of the main parts of a fluorine gas generator according to the invention.
Figure 2:
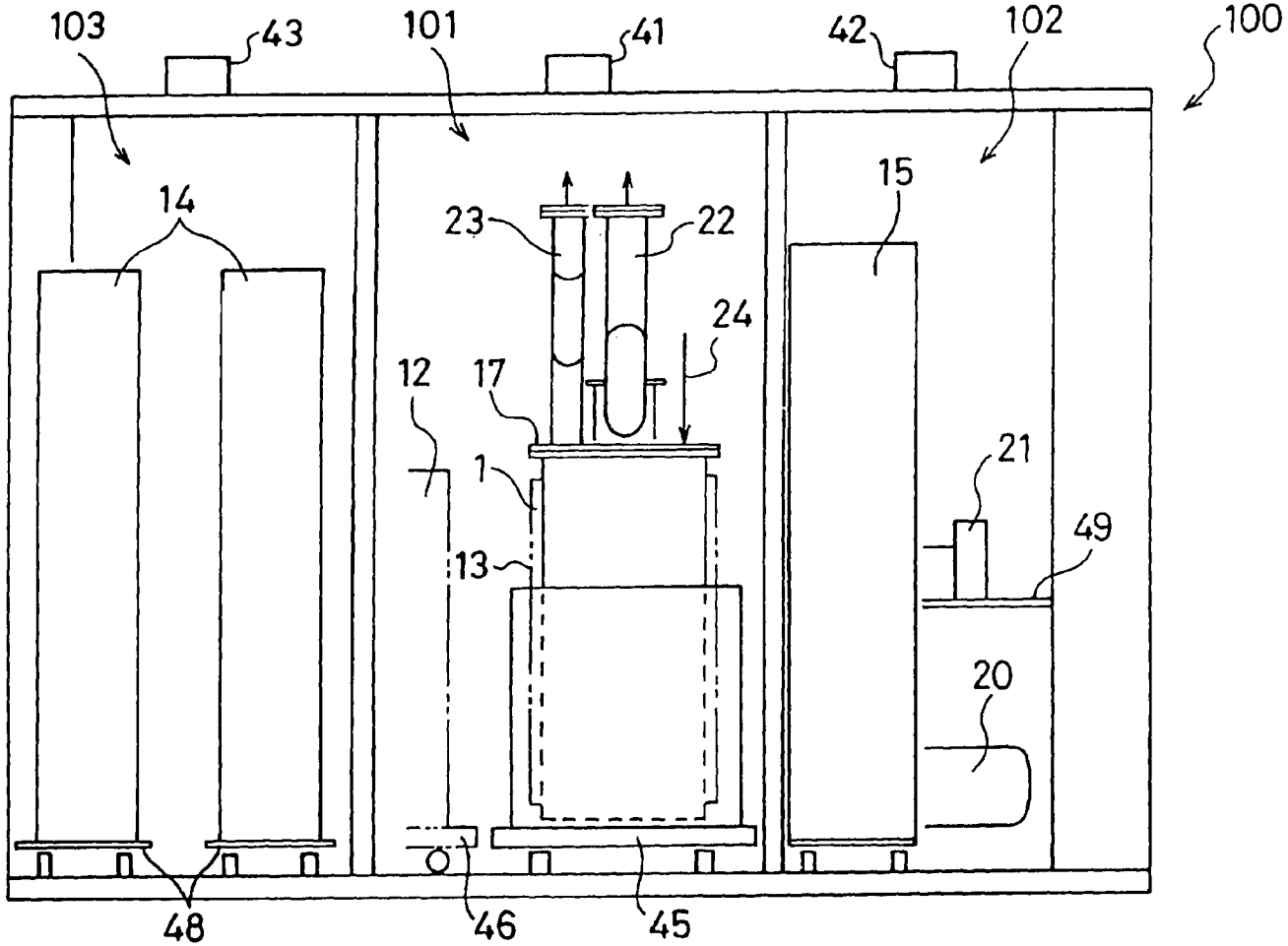
FIG. 2 is a front view of a fluorine gas generator according to the invention.
Figure 3:
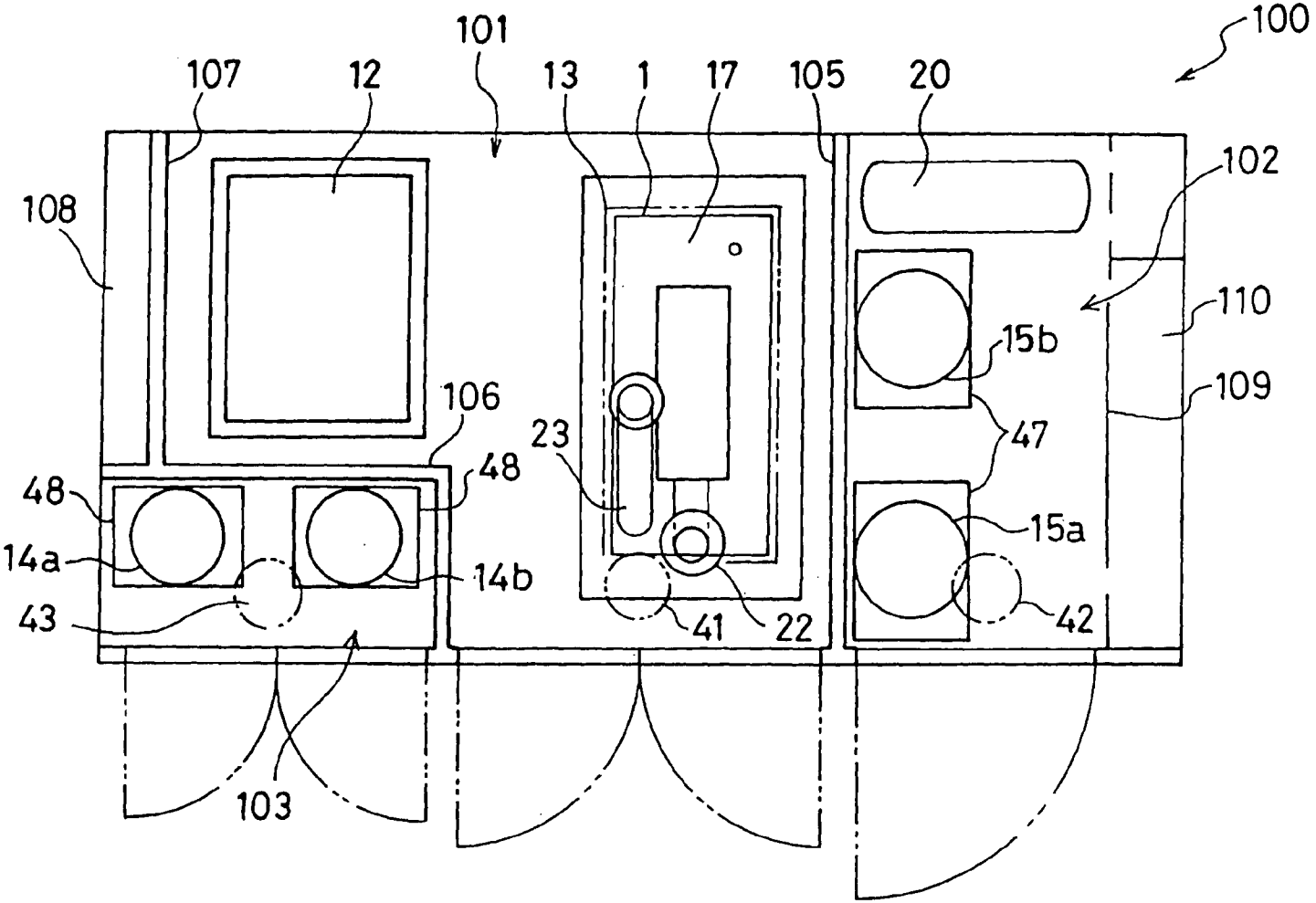
FIG. 3 is a top view of a fluorine gas generator according to the invention.
Figure 4:
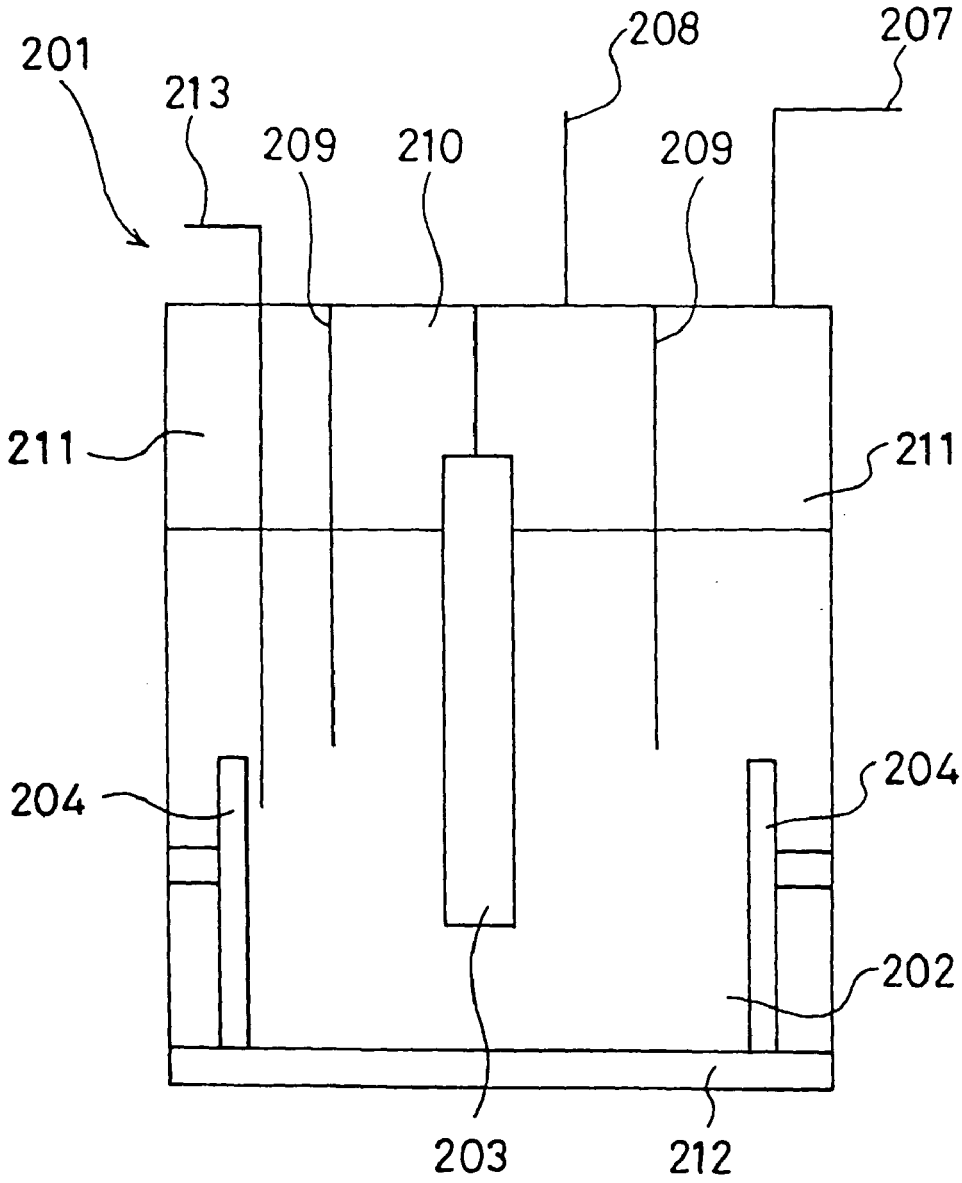
FIG. 4 is a schematic view of a fluorine gas generator in conventional use.

FIG. 1 is a schematic representation of the main parts of a fluorine gas generator according to the invention. In FIG. 1, the section 100 surrounded by a dot-and-dash line indicates a box-shaped body. As shown in FIG. 2 and FIG. 3, the box-shaped body 100 has an approximately rectangular shape. The inside of this box-shaped body 100 is divided into a first compartment 101, a second compartment 102, and a third compartment 103. This partitioning is realized by means of partition walls 105 and 106 extending from top to bottom. Due to the partitioning effect of these partition walls 105 and 106, the gases in different compartments cannot be mixed together. In FIG. 1, the portion 101 surrounded by a broken line indicates the first compartment, the portion 102 the second compartment, and the portion 103 the third compartment.

In the first compartment 101 in FIG. 1, there is contained an electrolyzer 1. In the first compartment 101, there is further contained a water heating device 12. In the electrolyzer 1, an electrolytic bath comprising a KF—HF system mixed molten salt 2 is formed. The electrolyzer 1 comprises an anode chamber or section 3 and a cathode chamber or section 4. An anode 5 is disposed in the anode chamber 3. A cathode 6 is disposed in the cathode chamber 4. The anode chamber 3 is provided with a fluorine gas discharge port 22 for the fluorine gas generated from the anode chamber 3. The cathode chamber 4 is provided with a hydrogen gas discharge port 23 for the hydrogen gas generated from the cathode chamber 4. Further, an HF feeding line 24 for feeding hydrogen fluoride (HF) to the electrolyzer is connected to the cathode chamber 4. The reference numeral 13 indicates a warm water jacket for warming the electrolyzer 1. The water heating device 12 feeds warm water to the warm water jacket 13.

The second compartment 102 contains HF adsorption column system (first adsorption means) 15 for removing HF from the fluorine gas discharged from the anode chamber 3. The second compartment 102 further contains a buffer tank (reservoir means) 20 and a compressor (pressurizing means) 21. The buffer tank 20 is reservoir means for storing the fluorine gas generated. The compressor 21 is pressurizing means for adjusting the pressure in the buffer tank 20. The HF adsorption column system 15 is packed with NaF or the like for the adsorption of HF from the mixed gas composed of $F_2$ and HF discharged from the anode chamber 3 and the lease of high-purity fluorine gas alone. For packing material exchange, there are disposed two or more HF adsorption means in parallel and it is possible to switch over either one of them by means of valves.

The third compartment 103 contains HF adsorption column system (second adsorption means) 14 for removing HF from the HF-containing hydrogen gas discharged from the cathode chamber 4. A vacuum generator 26 for depressurizing the hydrogen gas discharge port connected to the hydrogen is connected to the hydrogen discharge port 23. The HF adsorption column system 14 is packed with soda lime or the like for the adsorption of HF from the hydrogen-HF mixed gas discharged from the cathode chamber 4. For packing material exchange, there are disposed two or more HF adsorption means in parallel and it is possible to switch over either one of them by means of valves.

The electrolyzer 1 is made of a metal or alloy such as Ni, Monel, pure iron or stainless steel. The electrolyzer 1 comprises the anode chamber 3 located in the middle thereof and the cathode chamber 4 surrounding the anode chamber 3. The anode 5 is disposed in the anode chamber 3. The cathode 6 is disposed in the cathode chamber 4. A low-polarizable carbon electrode is preferably used as the anode 5. The cathode 6 is preferably made of Ni or the like. The top cover 17 of the electrolyzer 1 is equipped with the discharge port 22 for the fluorine gas generated from the anode chamber 3, the discharge port 23 for the hydrogen gas generated from the cathode chamber 4, an HF inlet 25 from the HF feeding line 24 for feeding HF when the surface level of the electrolytic bath 2 lowers to a certain predetermined height, first and second bath level detecting means (not shown) for detecting the bath levels in the anode chamber 3 and cathode chamber 4, respectively, and pressure gages 7 and 8 for detecting the internal pressures in the anode chamber 3 and cathode chamber 4, respectively. The gas discharge ports 22 and 23 are each provided with a bent tube made of a material resistant to corrosion by fluorine gas, for example Hastelloy, and serving to prevent splashes from the anode chamber 3 or cathode chamber 4 from entering each gas line. The HF feeding line 24 is covered with a temperature adjusting heater 24*a* for preventing liquefaction of HF.

The second adsorption means or column system 14 for adsorbing HF in the hydrogen gas discharged from the cathode chamber 4 comprises an HF adsorption column 14*a* and an HF adsorption column 14*b* disposed in parallel. These HF adsorption columns 14*a* and 14*b* may be operated simultaneously or either one of them alone may be operated. These HF adsorption columns 14 have pressure gages 30*a* and 30*b* by which internal choking or clogging can be detected. The HF adsorption columns are preferably made of a material resistant to corrosion by fluorine gas and HF, for example stainless steel, Monel, Ni or a fluororesin, and are packed with soda lime for adsorbing HF passing therethrough to thereby remove HF from the hydrogen gas.

The HF adsorption column system 14 is disposed on the downstream side of a piezovalve (in FIG. 2, abbreviated as "PV") 10, which is a constituent of pressure maintenance means. Between this piezovalve 10 and the HF adsorption column 14, there is disposed a vacuum generator 26. This vacuum generator 26 serves to reduce the pressure in the gas line 28 through the ejector effect of a gas passing through a gas line 27. It can place the gas line 28 under a reduced pressure state without using any oil and thus can prevent any oil from entering the gas line and electrolyzer 1. Used as the gas is an inert gas such as nitrogen. The piezovalve 10 is provided so that the pressure reduction by the vacuum generator 26 may not exert any influence on the electrolyzer 1. This piezovalve 10 thus serves as a constituent of pressure maintenance means for the electrolyzer 1.

Like the above-mentioned HF adsorption column system 14, the first adsorption means or column system 15 for removing HF from the fluorine gas discharged from the anode chamber 3 comprises two HF adsorption columns 15*a* and 15*b* disposed in parallel. The HF adsorption column system 15 is equipped with pressure gages 29*a* and 29*b*, by which internal choking or clogging can be detected. The system contains NaF therewithin for removing HF contained in the fluorine gas discharged. Like the HF adsorption column system 14, the HF adsorption column system 15 is preferably made of a material resistant to corrosion by fluorine gas and HF, for example stainless steel, Monel, Ni or the like.

On the upstream and downstream sides of the HF adsorption column system 15, there are provided piezovalves 9*a* and 9*b*, which are constituents of pressure maintenance means. The electrolyzer 1 and HF adsorption column system 15 are connected to a compressor, so that the electrolyzer 1 and HF adsorption column system 15 are always placed in a reduced pressure state. Therefore, the piezovalves 9*a* and 9*b* are disposed at the sites mentioned above to thereby prevent that reduced pressure from influencing the electrolyzer inside. These piezovalves 9*a* and 9*b* serve as constituents of the pressure maintenance means for the electrolyzer.

FIG. 2 is a front view illustrating the fluorine gas generator in the embodiment mentioned above, and FIG. 3 is a top view thereof The fluorine gas generator in this embodiment is contained as a whole in the box-shaped body 100 to form a unit, and the body-shaped body inside is divided into three compartments by means of the partition walls 105 and 106. Seen from the front, the first compartment 101 is found in the middle, the second compartment 102 on the right side of the first compartment, and the third compartment 103 on the left side of the first compartment. The first compartment 101 extends further to the back of the third compartment 103.

The first compartment 101 is a central compartment in the box-shaped body 100 and is provided with a suction opening 41 on the ceiling. Within the first compartment 101 and in the middle of the box-shaped body 100, there is disposed the electrolyzer 1. The electrolyzer 1, which is equipped with the warm water jacket 13, fluorine gas discharge port 22, hydrogen gas discharge port 23 and so on, is mounted on a transporting member 45, for example a truck, and thus is transportable. Seen from the front, at the back on the left side of the electrolyzer 1 and at the back of the third compartment, there is disposed the water heating device 12 connected to the warm water jacket 13. The water heating device 12 is also mounted on a transporting member 46, for example a truck, and thus is transportable. The front side of this first compartment 101 can be opened and closed by means of a double door, for instance. By continuous or intermittent suctioning through the suction opening 41, the internal gas is prevented from leaking into the outside atmosphere. In the section 108 neighboring the first compartment 101, separated therefrom by a partition wall 107 and facing toward the outside, there are contained electric connection devices. When the outside wall of the section 108 facing toward the outside is removed, maintenance of the internal electric connection devices becomes possible.

Seen from the front, the second compartment 102 is found on the right side of the first compartment. The ceiling of the second compartment 102 is provided with a suction opening 42. The second compartment 102 contains the first adsorption means for removing HF in the fluorine gas discharged from the anode chamber 3, namely the HF adsorption columns 15*a* and 15*b* disposed in parallel in front and rear positions. The HF adsorption columns 15*a* and 15*b* are mounted on respective transporting members 47, for example trucks, and are thus transportable. Further at the back of the HF adsorption column system 15, there is disposed a shelf 49 dividing the relevant space into upper and lower stages. On the shelf, the compressor 21 is disposed, and the buffer tank 20 is disposed in the lower space. The front side of the second compartment 102 can be opened and closed by means of a single swing door, for instance. By continuous or intermittent suctioning through the suction opening 42, the internal gas is prevented from leaking into the outside atmosphere. In the section 110 separated from the second compartment 102 by an internal partition wall 109 and facing toward the outside, there is contained a valve stand for an inert gas purging line (not shown). When the outside wall of the section 110 facing toward the outside is removed, the valves in the inside can be operated.

Seen from the front, the third compartment 103 is located on the left side of the first compartment. The ceiling of the third compartment 103 is provided with a suction opening 43. The third compartment 103 contains the second adsorption means for removing HF in the hydrogen gas discharged from the cathode chamber 4, namely the two HF adsorption columns 14*a* and 14*b* disposed in parallel in front and rear positions. The HF adsorption columns 14*a* and 14*b* are mounted on respective transporting members 48, for example trucks, and are thus transportable. The front side and/or rear side of the third compartment 103 can be opened and closed by means of a single swing door, for instance. By continuous or intermittent suctioning through the suction opening 43, the internal gas is prevented from leaking into the outside atmosphere.

How to operate the fluorine gas generator in this embodiment is now described. In a normal state of progress of electrolysis, fluorine gas is generally generated from the surface of the anode 5, and hydrogen gas from the surface of the cathode 6. For conducting the electrolysis efficiently, the electrolyzer 1 is warmed by the warm water jacket 13. The temperature of the warm water jacket 13 is adjusted by the thermometer 11 monitoring the temperature of the electrolytic bath and the water heating device 12 heating the water to be fed to the warm water jacket 13. The fluorine gas generated is fed to the relevant production line via the fluorine gas discharge port 22. When the amount of the electrolytic bath 2 decreases as a result of a series of electrolysis, the level detecting means (not shown) come into action and, in association with this action, HF is fed to the electrolytic bath 2 through the HF feeding inlet 25 from the HF feeding line 24.

The fluorine gas coming from the fluorine discharge port 22 contains HF originally occurring in the electrolyzer. Therefore, the fluorine gas generated is passed through the HF adsorption column system 15 for removing the contaminant HF to give highly pure fluorine gas. The HF adsorption column system 15 comprises at least two columns disposed in parallel, and both or either one of the HF adsorption columns 15 can be operated selectively by operating valves disposed on the upstream and downstream sides of the HF adsorption columns. When required, the high-purity fluorine gas deprived of HF is supplied stably in a required amount from the buffer tank 20 disposed behind line branching on the upstream side of the HF adsorption column system 15. The pressure within the buffer tank 20 is adjusted by means of the compressor 21.

The hydrogen gas coming from the hydrogen gas discharge port 23 contains HF originally occurring in the electrolyzer. Therefore, the hydrogen gas generated is passed through the HF adsorption column system 14 to remove HF, which is corrosive. The HF adsorption column system 14 also comprises two columns disposed in parallel, and both or either one of the HF adsorption columns 14 can be operated selectively by operating valves disposed on the upstream and downstream sides of the HF adsorption column system.

In case of gas leakage from the fluorine gas generator, a gas detector disposed in each compartment detects the gas leakage. The generator is so constituted so that the detection signal can cause an emergency stop of the generator. The leakage gas is suctioned for due treatment through the suction openings 41, 42 and 43 respectively provided on the ceilings of the first, second and third compartments. The gas in the first compartment is HF, the gas mainly handled in the second compartment is fluorine gas, and the gas mainly handled in the third compartment is hydrogen gas, and the gas species are thus restricted according to the compartments, hence the chance of mixing of a plurality of gases diminishes.

For maintenance or exchange of the electrolyzer 1, the electrolyzer 1 is drawn out together with the transporting member. For maintenance or exchange of the water heating device 12, the electrolyzer 1 is drawn out together with the transporting member and, then, the maintenance operation for the water heating device 12 is carried out.

For maintenance or exchange of the HF adsorption column system 14 or 15, the HF adsorption column system 14 or 15 is drawn out together with the relevant transporting member(s). On this occasion, since each of the HF adsorption column systems 14 and 15 comprises two column disposed in parallel, only one of them may be drawn out after due operation of the valves.

The box-shaped body 100 may comprise only two components, namely a first compartment containing the electrolyzer 1 and another compartment.

In the fluorine gas generator constituted in the manner described above according to the invention, the gases used and/or generated, in case of leakage thereof, can be prevented from mixing together as far as possible. Even in case of gas leakage into the outside of the generator system, the leakage gas can be treated safely. The partial maintenance and/or exchange operations for the generator constituents are easy to carry out in the fluorine gas generator provided by the invention.

DESCRIPTION OF THE REFERENCE NUMBERS

1 Electrolyzer
2 Electrolytic bath
3 Anode chamber
4 Cathode chamber
5 Anode
6 Cathode
12 Water heating device
13 Warm water jacket
14 HF adsorption column system (second adsorption means)
14*a* HF adsorption column
14*b* HF adsorption column
15 HF adsorption column system (first adsorption means)
15*a* HF adsorption column
15*b* HF adsorption column
20 Buffer tank (reservoir means)
21 Compressor (pressurizing means)
22 Discharge port for the fluorine gas
23 Discharge port for the hydrogen gas
24 HF feeding line
25 HF inlet
45 Transporting member
46 Transporting member
47 Transporting member
100 Box-shaped body
101 First compartment
102 Second compartment
103 Third compartment

What is claimed is:

1. A fluorine gas generator comprising:

a box-shaped body containing an electrolyzer for fluorine gas generation, said box-shaped body being partitioned into at least three compartments separated from each other by internal partition walls such that gases in the at least three compartments do not mix together, including:

a first compartment containing said electrolyzer;

a second compartment containing a first adsorption unit that adsorbs hydrogen fluoride from fluorine gas discharged from an anode chamber of the electrolyzer; and a third compartment containing a second adsorption unit that adsorbs hydrogen fluoride from hydrogen gas discharged from a cathode chamber of the electrolyzer, wherein said second compartment and said third compartment are respectively provided directly adjacent to said first compartment, and said first compartment is located between said second compartment and said third compartment so that said second compartment and said third compartment are not in contact with each other.

2. The fluorine gas generator according to claim 1, wherein said box-shaped body is formed as a unit.

3. A fluorine gas generator comprising:

an electrolyzer containing an electrolytic bath composed of a mixed molten salt containing hydrogen fluoride and divided into an anode chamber with an anode disposed therein and a cathode chamber with a cathode disposed therein, a first adsorption unit that adsorbs hydrogen fluoride from the fluorine gas discharged from the anode chamber, a second adsorption unit that adsorbs hydrogen fluoride from the hydrogen gas discharged from the cathode chamber, and a box-shaped body containing the electrolyzer, the first adsorption unit, and the second adsorption unit, said box-shaped body comprising three compartments separated from each other by internal partition walls such that gases in the at least three compartments do not mix together, and including a first compartment containing said electrolyzer, a second compartment containing said first adsorption unit, and a third compartment containing said second adsorption unit, wherein said second compartment and said third compartment are respectively provided directly adjacent to said first compartment, and said first compartment is located between said second compartment and said third compartment so that said second compartment and said third compartment are not in contact with each other.

4. The fluorine gas generator according to claim 3, wherein each of the first to third compartments is provided with a suction opening for suctioning the internal air.

5. The fluorine gas generator according to claim 3 or 4, wherein said second compartment contains a reservoir tank for storing the fluorine gas after passing through said first adsorption unit and a pressurizing device configured to pressurize the fluorine gas from said reservoir tank.

6. The fluorine gas generator according to claim 3, wherein said first compartment contains a water heating device for feeding warm water to said electrolyzer for heating said electrolyzer.

7. The fluorine gas generator according to claim 3, wherein said electrolyzer is mounted on a transporting member capable of entering and leaving said first compartment.

8. The fluorine gas generator according to claim 7, wherein said first adsorption unit comprises at least two adsorption columns, wherein each adsorption column can be operated alone or more than one adsorption column can be operated simultaneously, and each of the adsorption columns is mounted on a transporting member capable of entering and leaving the second compartment.

9. The fluorine gas generator according to claim 7, wherein said second adsorption unit comprises at least two adsorption columns, wherein each adsorption column can be operated alone or more than one adsorption column can be operated simultaneously, and each of the adsorption columns is mounted on a transporting member capable of entering and leaving the third compartment.

10. The fluorine gas generator according to claim 3, wherein said box-shaped body is formed as a unit.

* * * * *